United States Patent [19]

Barkhuus

[11] 4,054,097

[45] Oct. 18, 1977

[54] METHOD AND APPARATUS FOR INCINERATING LIQUID, GASEOUS AND PASTY WASTE

[76] Inventor: Per W. Barkhuus, 1699 Chesalles-sur-Oron, Switzerland

[21] Appl. No.: 667,648

[22] Filed: Mar. 17, 1976

[51] Int. Cl.[2] ..... F23G 5/06

[52] U.S. Cl. ..... 110/7 B; 110/14; 110/8 A; 431/1

[58] Field of Search ..... 110/7 R, 7 B, 8 A, 8 C, 110/14; 239/102; 431/1

[56] References Cited

U.S. PATENT DOCUMENTS

| | | | |
|---|---|---|---|
| 3,297,255 | 1/1967 | Fortman | 239/102 |
| 3,436,061 | 4/1969 | Zinn | 110/14 |
| 3,513,788 | 5/1970 | Ostrin | 110/14 |
| 3,547,056 | 12/1970 | Niesson | 110/7 |
| 3,774,846 | 11/1973 | Schurig et al. | 239/102 |
| 3,848,548 | 11/1974 | Bolejack, Jr. et al. | 110/14 |

FOREIGN PATENT DOCUMENTS

| | | | |
|---|---|---|---|
| 1,306,561 | 2/1973 | United Kingdom | 110/7 |

*Primary Examiner*—Kenneth W. Sprague
*Attorney, Agent, or Firm*—William E. Cleaver

[57] ABSTRACT

In a process for incinerating liquid, gaseous or pasty waste, the steps of producing a high frequency vibratory flow of a fluid in a pulverzing chamber, introducing the liquid, gaseous or pasty waste into the chamber to be pulverized in said high frequency vibratory fluid flow, providing combustion air to be drawn into said high frequency vibratory flow to be mixed with said pulverized waste and igniting the mixture of pulverized waste and combustion air. In addition the present arrangement provides a chamber in which waste material is pulverized. The chamber is equipped with first aperture means and second aperture means. Within the chamber and disposed to face said first aperture is a cavity resonator so that when high pressure fluid passes through said first aperture there results a high frequency vibratory flow of said fluid. Waste material is passed into the chamber through said second aperture simultaneously with combustion air being passed in proximity to the entrance of the chamber lying away from said first aperture. Both the waste material and the combustion air are drawn into the vibratory movement of the fluid and this results in pulverizing the waste material while mixing the pulverized waste with combustion air to render the mixture readily available for incineration.

7 Claims, 6 Drawing Figures

METHOD AND APPARATUS FOR INCINERATING LIQUID, GASEOUS AND PASTY WASTE

The present invention relates to a method and apparatus for incinerating liquid, gaseous and paste-like waste products.

Different types of apparatus are known for incinerating waste products such as oil, mud and petroleum by-products. Thus, if the waste product is oil or another combustible liquid product, burners having nozzles or rotating discs can be used. If, however, the waste is mud or the like it is necessary to extract as much solid material as possible, which solids are subsequently burnt in a garbage incinerating furnace.

Such arrangements do, however, suffer from disadvantages which limit their possibilities of use as well as their yield.

Thus, a burner can only be used if the waste is a combustible liquid. Rotating disc burners become clogged easily whilst burners having nozzles necessitate pulverisation of the liquid waste so that it can pass through an orifice of small diameter which, in general, is less than 1 millimeter. It is therefore essential that the waste does not contain any particles which have a diameter greater than that of the nozzle. Accordingly, prior filtration or decantation of the waste must be carried out, which is both long and complicated. Moreover, combustion of the waste is rarely effected to completion and the apparatus disgorges smoke, which must be eliminated by ancillary apparatus.

When the waste is mud or used water, the extraction of solid materials necessitates the use of costly apparatus. Moreover, the water which is recovered is not bacteriologically clean, whilst the dried mud only burns with difficulty in garbage incinerating furnaces.

Finally, the disposal of explosive gaseous waste or those containing solid substances is a delicate operation and necessitates an apparatus which must be closely monitored.

The object of the present invention is to provide a process and apparatus for the incineration of liquid, gaseous or pasty waste which are combustible, non-combustible or explosive, either simultaneously or separately and, if desired, using combustible additives.

According to the present invention, there is provided an apparatus for incinerating liquid, gaseous or pasty waste, comprising a burner element provided with a combustion air intake disposed in the region of a feed piece, the feed piece having a first cavity formed therein, an aperture being provided therein located opposite a resonant cavity formed in a cavity resonator the resonant cavity being located within said first cavity, the aperture being connectable to a source of fluid under pressure, the said feed piece having channels formed therein which discharge into said first cavity and being connectable to a feed source of liquid, gaseous or pasty waste.

Also according to the present invention, there is provided a process for incinerating liquid, gaseous or pasty waste, comprising the steps of producing a high frequency vibratory condition in a cavity, drawing combustion air into the energy field created by the high frequency vibratory condition, and introducing the liquid, gaseous or pasty waste into the cavity prior to the waste being incinerated.

The invention will be further described, by way of example, with reference to the accompanying drawings, in which.

Figure 1:
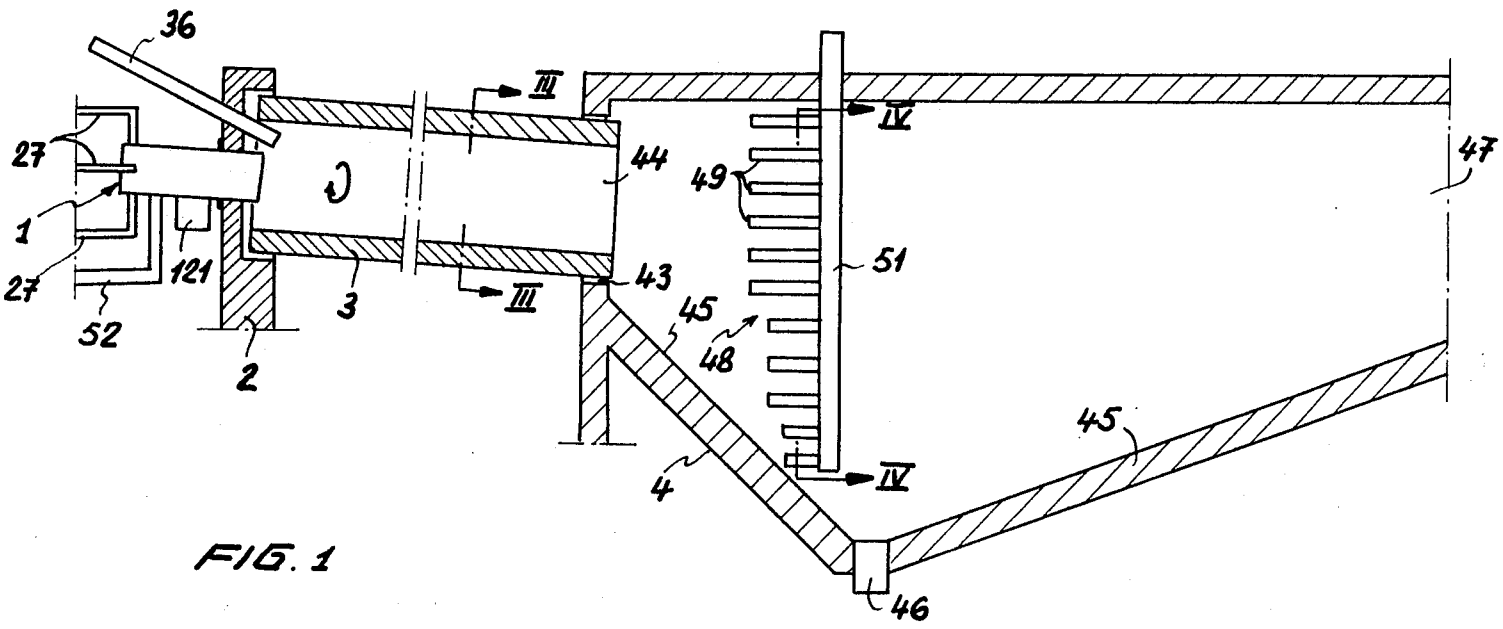
FIG. 1 is a schematic sectional view of an apparatus in accordance with the present invention.

In FIG. 1 there is shown an apparatus comprising a burner element 1 mounted on a housing 2, one of the ends of the element 1 opening into one end of an inclined furnace 3 rotatably mounted on the housing 2, the other end of the furnace 3 opening into a fixed after-combustion furnace 4.

Figure 3:
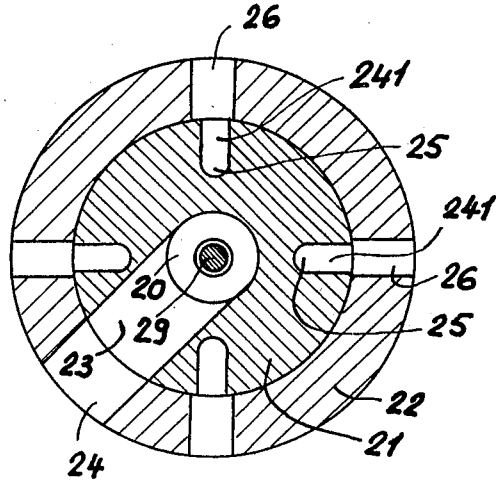
FIG. 3 is a sectional view taken along the line I—I of FIG. 2.
Figure 4:
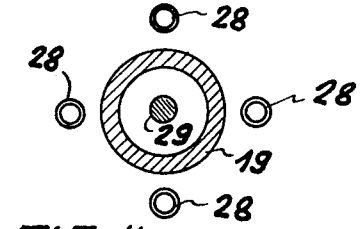
FIG. 4 is a sectional view taken along the line II—II of FIG. 2.
Figure 2:
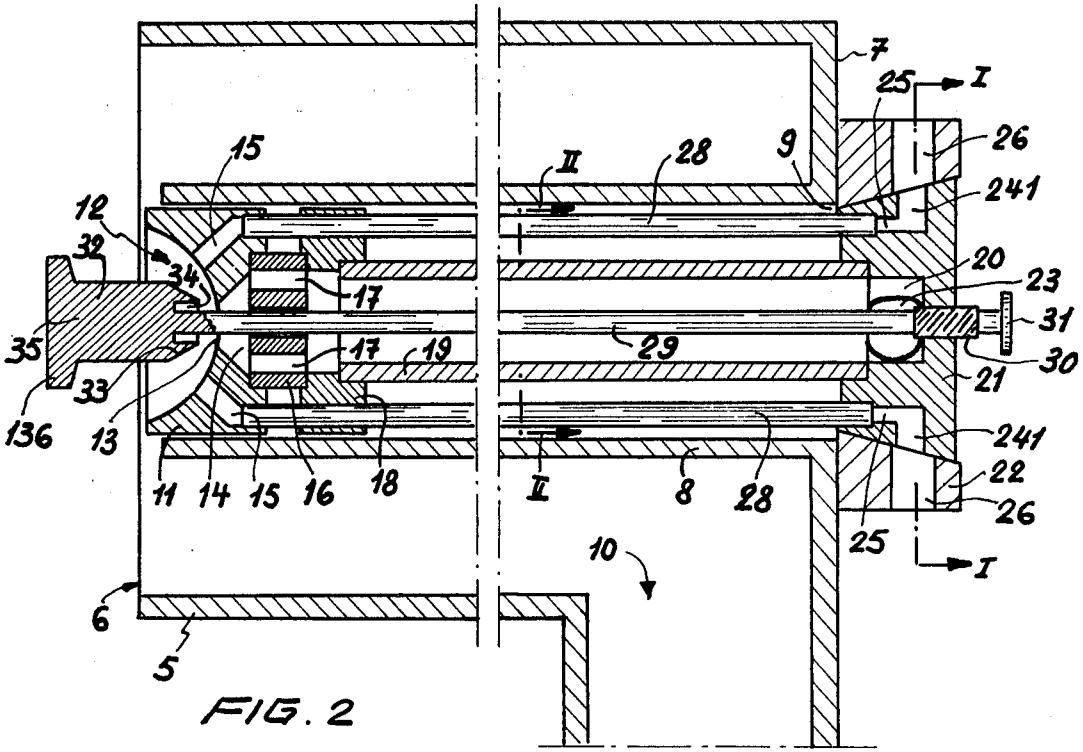
FIG. 2 is a schematic section of a detail of the apparatus shown in FIG. 1, on an enlarged scale.

The burner element 1, as best seen in FIGS. 2, 3 and 4 comprises a tubular body 5, one end 6 of which is open and extends into the rotating furnace 3. The other end of the body 5 comprises a base portion 7 carrying a tubular sleeve 8 which extends into the body 5 and defines an opening 9 in the base 7. One of the lateral walls of the body 5 has an aperture 10 formed therethrough and carries a coupling tube 121 adapted to be connected to the source of air (not shown). Thus when the air is passed through the coupling tube 121, this air enters the space in the body 5 delimited by the sleeve 8 and exits from the body 5 through the end 6 thereof.

In the free end of the sleeve 8, a feed block 11 is housed which comprises a solid portion of generally cylindrical form in which there is provided a concave cavity 12, the concavity of which faces the open end 6 of the body 5. In the embodiment shown, the cavity 12 is of substantially hemispherical form. This, however, is not essential and the cavity 12 can be, for example, cylindrical or parabolic.

In the base of the cavity 12 an opening 13 is provided which forms the end of a longitudinal channel 14 formed in the block 11, this channel 14 having a tapering section such that the smaller end of the channel is adjacent the opening 13. The block 11 also has a series of channel 15 formed therein discharging into the base of the cavity 12 around the narrow end of the channel 14 on the face of the block 11 opposed to the cavity 12.

In the channel 14 formed in the block 11, a cylindrical member 16 is located which is provided with a series of longitudinal channels 17 extending therethrough which communicate with the channel 14 and with the interior of the positioning ring 18 connected to the cylindrical member 16. This member 16 is retained in position by any suitable means, such as a screw (not shown). Fixedly engaged, for example, by soldering, the ring 18 is one end of a tube 19 extending into the sleeve 8, the other end of the tube 19 being similarly fixedly engaged in the central channel 20 of a distribution abutment member 21 disposed exteriorly of the body 5 and opposite the opening 9 formed in the base 7 of the body. The abutment member 21 bears against a distributing ring 22 which is fixed to the base 7 of the body 5 by any suitable means, for example, a screw (not shown). The support of the abutment member 21 in the ring 22 is effected by making the peripheral wall of the abutment member 21 and the inner wall of the ring in truncated form, such that these two members engage. The retention of the abutment member 21 in the ring 22 can be ensured in any appropriate manner, for example, by using a retaining plate (not shown) which is screwed to the ring 22. The abutment member 21 has a radial feed channel 23 for air or steam formed therein which discharges both into the central channel 20 and, around the periphery of the abutment member 21, this channel 23 being capable of communicating with a corresponding radial channel 24, as shown in FIG. 3, provided in the ring 22 and adapted to be coupled by means of a pipe 52, as shown in FIG. 1, to a feed source for air or for steam under pressure (not shown). The abutment member 21 is also provided with a series of radial channels 241 each connected to an axial channel 25 also formed in the abutment member 21 and which discharges towards the interior of the sleeve 8. Each of the radial channels 241 is capable of communicating with a radial channel 26 formed in the ring 22 and adapted to be coupled, by means of a pipe 27, as shown in FIG. 1, to a feed source of liquid, gaseous or pasty waste, to which there may or may not have been added a combustible additive.

In the sleeve 8, tubes 28 which respectively engage in the positioning ring 18, are provided. One end of each of these tubes 28 engages in one of the channels 15 formed in the block 11 and the other end thereof each engage in one of the channels 25 formed in the abutment member 21. Thus, the tubes 28 connect the channels 241 and 25 of the abutment member 21 to the channels 15 formed in the feed block 11.

A rod 29 is disposed in the tube 19 which slidingly engages in the cylindrical member 16. One of the ends of the rod 29 is threaded at 30 and engages in the wall of the abutment member 21, this end projecting externally of the abutment member 21 and carrying an operating disc 31. The other end of the rod 29, which passes through the channel 14 formed in the feed block 11, emerges into the cavity 12 and carries a substantially cyclindrical member 32. One end 33 of member 32 has a circular groove or channel 34 formed therein and said channel 34 is disposed in the cavity 12 of block 11 facing opposite the narrow end 13 of the channel 14. In the embodiment shown, the cylindrical portion 32 is located at the base of the cavity 34. The other end 35 of the portion 32 carries a circular shoulder 136 which acts as a deflector. The cavity 34 of the part 32 forms a device known as a "Hartmann whistle". It is appropriate to mention that the Hartmann whistle is found in the cavity 12 and that the relative distance between the base of the hollow 34 and the narrow end 13 of the cavity can be adjusted by screwing or unscrewing the rod 29 in the wall of the abutment member 21. It is appropriate to mention that the block 11, the portion 16, the ring 18, the tube 19, the tubes 28, the rod 29, the part 32 and the abutment member 21 together form an assembly which can be introduced and removed at will from the burner element 1.

In the proximity of the burner element 1, a pipe 36 (FIG. 1) of relatively large cross-section is provided on the housing 2 which emerges into the furnace 3, this pipe being adapted to discharge solid waste into the furnace 3.

Figure 5:
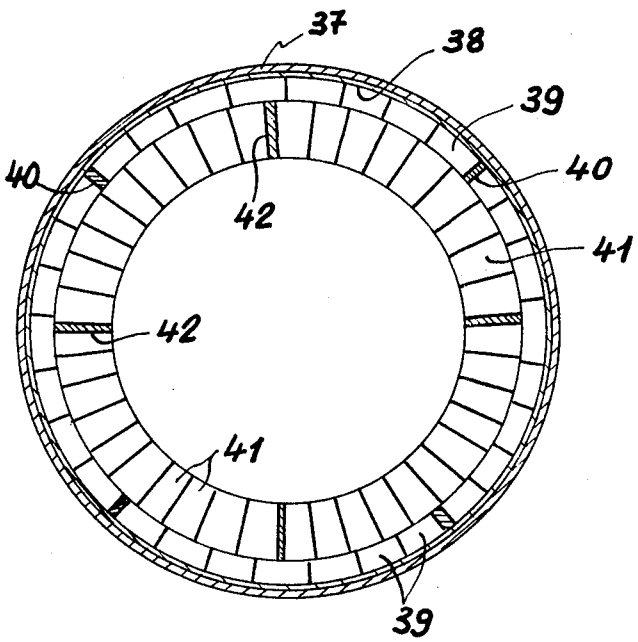
FIG. 5 is a schematic section taken along the line III—III of FIG. 1; on an enlarged scale relative thereto.

The furnace 3, as shown in FIGS. 1 and 5, is inclined in the direction of the after-combustion furnace 4. It is rotatably mounted in the housing 2 in a known manner which will not be described in detail since it forms no part of the present invention. This furnace 3 comprises an outer tubular wall 37 formed of sheet metal within which is disposed a lining 38 of heatresistant material, for example, an asbestos layer. Inside the lining 38, a row of refractory insulating bricks 39 are provided. Some of the bricks 39 have compressible, heat-resistant cullular members 40 disposed therein, such as asbestos plates. Inside the row or bricks 39, there is disposed a further layer of refractory bricks 41, some of these also being likewise separated by cellular members formed of similar heat-resistant compressible elements 42. The compressible cellular members 40 and 42 permit certain movement of the bricks 39 and 41 whilst preventing them from rupturing.

Figure 6:
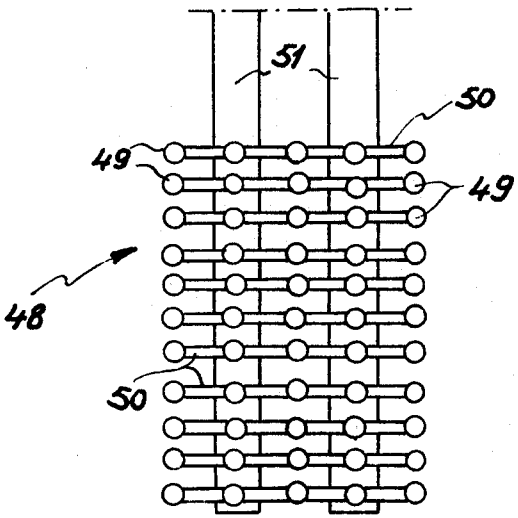
FIG. 6 is a schematic view along the line IV—IV of FIG. 1.

The after-combustion furnace 4, as shown in FIGS. 1 and 6, comprises, in a known manner, a mouth 43 in which is housed the outlet 44 of the rotatable furnace 3, an assembly of inclined walls 45 adapted to cause the ash to slide towards an orifice 46 for evacuating the ash from the furnace. Opposite the mouth 43, the post combustion furnace 4 is provided with an orifice 47 for discharge of the fumes, this opening being connected to a purifying system for the fumes. These structures are both known and will not be further described in detail.

In the after-combustion furnace 4, opposite its mouth 43, a network 48, as shown in FIGS. 1 and 6, of tubes 49 is provided, which tubes are disposed in parallel with one another in such a manner that their ends face the mouth 43. In the embodiment shown, these tubes 49 are disposed in five superposed ranges and the tubes 49 of each range are interconnected by connecting channels 50. The network 48 is connected to two tubular feed columns 51 which are themselves fixed to the wall of the after-combustion furnace 4 and connected to a source of pressurized air (not shown). Each of the tubular feed columns 51 sends air under pressure into the tubes 49 of one range of tubes from whence the air passes into the other ranges of tubes. The tubes direct the air against the mouth 43 of the after-combustion furnace 4.

The function of the apparatus described hereinbefore will now be described. The channel 23 (FIG. 2) is fed with fluid under pressure, for example, air or steam, which fluid passes through the tube 19, channels 17, the channel 14 and the construction 13 to impinge against the channel or cavity 34. In accordance with the known theory of the Hartmann whistle, the fluid under pressure is reflected at ultrasonic speed in the cavity 12 where its static pressure increases to a value which is greater than the vapour pressure of the fluid. Whilst the static pressure is greater than the vapour pressure, the fluid is evacuated from the cavity 12 which empties and therefore permits the cycle to be repeated. These periodic evacuations cause a high frequency vibratory flow to be set up in the cavity 12. When the high frequency vibratory flow is set up in the cavity 12, the opening 10 is fed with combustion air by means of the connecting tube 121. The tubes 28 are similarly fed with liquid, gaseous or pasty waste, with, if necessary, a combustible additive, such as gas, added thereto. This feeding is effected by means of the channels 241 and 25 from the abutment member 21 and by means of the channels 26 in the distribution ring 22 which are themselves connected to the channels 27. The waste, accompanied by the combustible additives if present, pass through the channels 15 in the block 11 and emerge into the cavity 12 where they are drawn into the energy field of the high frequency vibratory flow, which is produced in the said cavity. By cavitation, the wastes are pulverised into the very small particles having a diameter in the region of 1μ, and mixed with combustion air emerging from the end 6 of the body 5. The mixture is subsequently diffused externally of the cavity 12. It is convenient to recall that the pulverisation of the waste and its mixing with combustion air is particularly efficient due to the fact that when the waste materials emerge into the cavity 12, they are completely drawn into the energy field existing therein. Since the waste is intimately mixed with combustion air, it is easier to burn, the initial ignition being ensured by means of, for example, a pilot burner (not shown) located in the pulverisation zone for the waste.

Due to the fact that the part 32 is displaceable in the cavity 12 by a facile actuation of the operating disc 31 controlling the threaded rod 29, 30, it is possible to modify the flame produced by the system because in modifying the distance between the hollow and the narrow end 13, the form of the energy field is affected and consequently, so is the distribution and the diffusion of the pulverised mixture.

On the other hand, the deflector 136 makes it possible to localise the turbulence so that it occurs immediately rearward of the member 32. This prevents the flame being blown out or disturbed by uncontrolled turbulence.

It is important to note that the tubes 28 can be of relatively large cross-section, as can the channels 15 through which waste is forwarded into the cavity 12 since these channels 15 do not discharge into a nozzle of small diameter but into the cavity 12 which has very much larger dimensions. This offers the advantage that the feeding of waste does not become blocked, even if the waste is in the form of a paste including solid particles. Moreover, even if the waste itself is not combustible, the addition of a combustible additive is effected without difficulty, which additive is found to be intimately mixed with the waste and with the combustion air.

The combustion of the wastes is effected in known manner in the rotating furnace 3, in which the flame of the burner element 1 similarly ensures the combustion of solid waste disgorged into the furnace through the channel 36.

Due to the inclination and the rotation of the furnace 3, the soot resulting from the combustion of the materials is discharged into the mouth 43 of the after-combustion furnace 4. This soot arrives in the aftercombustion furnace 4 at a high temperature and at a certain flow rate, and collides with the pulsed combustion air flowing in the opposite direction which issues from the tubes 49 of the network 48 and the relative flow rates are locally annulled.

If the temperature of the soot is sufficiently high, fronts of flame are formed in the region where the relative flow rates are annulled and the after-combustion of the soot is effected automatically, without any priming. Since high temperatures prevail in the after-combustion furnace, the tubes 49 of the network 48 are heated to a high temperature and the air issuing thereform is also at a high temperature. This favors the formation and the maintenance of flame fronts.

If the soot arrives in the after-combustion chamber at a temperature which is too low to permit the spontaneous formation of flame fronts, it is necessary to reheat it. This can be effected with the aid of any suitable burner or burner element, for example, similar to that which has been previously described. This additional burner can be fed, for example, with used oil or gas of low commercial value and can be located for example at the entrance to the after-combustion furnace or in any other suitable place.

Thus, as previously stated, the ashes are evacuated through the orifice 46, whilst the fumes escape through the opening 47 and may thereafter be purified. It is worthy of note that the network 48 plays an important role in the purification of the fumes. In effect, the dust resulting from the combustion of the soots are filtered by the network 48 and are forced through the evacuating orifice 46 instead of passing through the opening 47 for the fumes.

What I claim is:

1. An apparatus for pulverizing waste and to be used with an ignition means to effect the incineration of said pulverized waste comprising in combination:

pulverizing chamber means formed to have a substantially concave shape and further formed to have first aperture means at approximately the base of said concave shape and to have second aperture means located toward the edge of said concave shape;

a source of high pressure fluid;

first conduit means connected between said source of high pressure fluid and said first aperture means and formed to permit said high pressure fluid to pass to and through said first aperture means;

resonant cavity means having a channel formed therein and disposed to protrude into said pulverizing chamber so that said channel lies opposite said first aperture means to directly receive said high pressure fluid passing therethrough whereby a high frequency vibratory flow of said fluid is set up within said pulverizing chamber;

a source of waste material;

second conduit means connected between said source of waste material and said second aperture means whereby when waste material enters said pulverizing chamber from said second aperture means it is drawn into said high frequency vibratory flow and pulverized thereby into very small particles of waste;

a source of combustion air;

third conduit means connected to said source of combustion air and formed to conduct said combustion air to be in close proximity to the edge of said pulverizing chamber to be drawn into said high frequency vibratory flow and mix with said particles of waste to form a mixture of small particles of waste material and combustion air which mixture will commence to incinerate in response to ignition from said ignition means.

2. An apparatus according to claim 1 wherein there is further included a rod means formed to have said resonant cavity means mounted on one end thereof, disposed to pass through said first aperture means and slideably mounted to move said resonant cavity means toward and away from said first aperture means to vary the distribution and diffusion of the mixture of pulverized waste and combustion air.

3. An apparatus according to claim 1 wherein said resonant cavity means is further formed to have a reflector means disposed toward its end away from said channel whereby turbulence accompanying the high frequency vibratory flow is localized in close proximity to said pulverizing chamber.

4. An apparatus according to claim 1 wherein there is further included a rotatable furnace means having an entrance aperture and an exit aperture, said rotatable furnace means disposed to have its entrance aperture receive said mixture of small particles of waste material and combustion air which mixture has commenced to incinerate, said rotatable furnace means being formed of refractory materials which maintain sufficiently high temperatures to maintain continued incineration within said rotatable furnace means.

5. An apparatus according to claim 4 wherein said rotatable furnace means comprises a cylindrical sheet metal external wall inside which is located an inner covering of heat-resistant material, a first plurality of insulating refractory bricks, at least some of which are separated from one another by a compressible, cellular heat-resistant member located within said inner covering and a further plurality of refractory bricks being located inside said first plurality of bricks, at least some of said further plurality of bricks also being separated from one another by a compressible cellular heat-resistant member.

6. An apparatus according to claim 4 wherein there is further included an after-combustion furnace means disposed to receive incinerated waste material from said rotatable furnace, said after-combustion furnace means including a network of interconnected tubes, one end of said network of tubes disposed to face the incoming incinerated waste material, a source of pulsing air connected to said network of tubes to provide pulsed air therethrough to impede the flow of the incinerated waste whereby the exhaust fumes will be cleaned.

7. A process for incinerating waste material employing a resonant cavity means comprising the steps of:

a. passing a high pressure fluid into said resonance cavity means to create a high frequency vibratory flow of said fluid;
b. passing waste material in close proximity to said resonant cavity means to be drawn into said high frequency vibratory flow of fluid to be pulverized thereby;
c. substantially simultaneously with step 2 passing combustion air in close proximity to said resonant cavity to be drawn into said high frequency vibratory flow to effect a mixture of said pulverized waste material and combustion air; and
d. igniting said mixture of said pulverized waste material and combustion air to initiate incineration thereof.

* * * * *